US008695390B2

(12) United States Patent
Ng et al.

(10) Patent No.: US 8,695,390 B2
(45) Date of Patent: Apr. 15, 2014

(54) WAFER CYLINDER HAVING BLOCKABLE WAFER TUMBLERS

(75) Inventors: Hoi Jarm Ng, Hong Kong (CN); Wai Leung Ng, legal representative, Hong Kong (CN); Thomas Becker, Hunfelden-Heringen (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 272 days.

(21) Appl. No.: 12/817,667

(22) Filed: Jun. 17, 2010

(65) Prior Publication Data

US 2010/0319420 A1 Dec. 23, 2010

(30) Foreign Application Priority Data

Jun. 23, 2009 (DE) ..... 10 2009 030 032

(51) Int. Cl.
*E05B 29/04* (2006.01)

(52) U.S. Cl.
USPC ..... 70/492; 70/419; 70/421; 70/495

(58) Field of Classification Search
USPC ..... 70/419, 492, 495, 365, 366, 377, 496, 70/421, DIG. 28, DIG. 29
See application file for complete search history.

(56) References Cited

U.S. PATENT DOCUMENTS 1,600,661 A * 9/1926 Winning ..... 70/492
1,965,889 A * 7/1934 Fitz ..... 70/419
2,139,842 A 12/1938 Miller
2,729,092 A * 1/1956 Taylor ..... 70/495
3,722,241 A * 3/1973 Sussina ..... 70/495
3,854,311 A 12/1974 Mercurio (Continued)

FOREIGN PATENT DOCUMENTS

AT 240 724 6/2003
DE 1 889 319 U 3/1964

(Continued)

OTHER PUBLICATIONS

German Search Report dated Apr. 13, 2010. DE 10 2009 030 032.5.

(Continued)

*Primary Examiner* — Lloyd Gall
(74) *Attorney, Agent, or Firm* — Gifford, Krass, Sprinkle, Anderson & Citkowski, P.C.

(57) ABSTRACT

The invention relates to a cylinder lock of the type of a disk tumbler cylinder having a cylinder housing and a cylinder core rotatable therein, with a plurality of blockable disk tumblers being provided in the cylinder core which have at least one respective engagement section. The disk tumblers are movable between an unlatched position and a latched position and are biased along a respective direction of bias into the latched position. In the latched position, the respective engagement section engages into an associated cut-out in the cylinder housing to block the cylinder core against a rotary movement relative to the cylinder housing. The cylinder core is rotatable in a rotary opening direction relative to the cylinder housing when the disk tumblers are in the unlatched position. At least one of the disk tumblers has a toothed zone which can be brought into engagement with a counter-toothed zone of the cylinder lock such that the disk tumbler is blocked against a movement opposite to the respective direction of bias when the disk tumbler is in the latched position and a torque is exerted onto the cylinder core in the rotary opening direction.

17 Claims, 3 Drawing Sheets

(56) References Cited

U.S. PATENT DOCUMENTS

| | | | | | |
|---|---|---|---|---|---|
| 3,990,282 | A | * | 11/1976 | Sorum | 70/495 |
| 3,999,413 | A | * | 12/1976 | Raymond et al. | 70/495 |
| 4,015,458 | A | * | 4/1977 | Mercurio | 70/495 |
| 4,376,382 | A | * | 3/1983 | Raymond et al. | 70/338 |
| 4,712,399 | A | * | 12/1987 | Mattossovich | 70/495 |
| 4,750,342 | A | * | 6/1988 | Nakai | 70/496 |
| 4,753,091 | A | * | 6/1988 | Sheets | 70/493 |
| 4,966,021 | A | * | 10/1990 | Boag | 70/383 |
| 5,134,871 | A | * | 8/1992 | Makino et al. | 70/492 |
| 5,765,417 | A | * | 6/1998 | Bolton | 70/495 |
| 6,119,495 | A | * | 9/2000 | Loreti | 70/340 |
| 7,424,815 | B1 | * | 9/2008 | Pagnoncelli | 70/340 |
| 7,634,930 | B2 | * | 12/2009 | Boesel et al. | 70/383 |
| 7,975,518 | B2 | * | 7/2011 | Chiang et al. | 70/383 |
| 2004/0069030 | A1 | * | 4/2004 | Takadama | 70/495 |
| 2007/0006623 | A1 | * | 1/2007 | Barrenberg et al. | 70/492 |

FOREIGN PATENT DOCUMENTS

| | | | |
|---|---|---|---|
| DE | 20 2008 001 880 | U1 | 4/2008 |
| DE | 10 2007 056 739 | A1 | 5/2009 |
| EP | 1 752 601 | A2 | 2/2007 |
| WO | WO-97/29262 | A2 | 8/1997 |

OTHER PUBLICATIONS

Japanese Office Action for JP Application No. 2010-141142 dated Jan. 7, 2014.

* cited by examiner

WAFER CYLINDER HAVING BLOCKABLE WAFER TUMBLERS

CROSS-REFERENCE TO RELATED APPLICATION

This application claims priority of German Patent Application 10 2009 030 032.5 filed Jun. 23, 2009.

FIELD OF THE INVENTION

The invention relates to a cylinder lock of the type of a disk tumbler cylinder (also denoted as a wafer cylinder) having a cylinder housing and a cylinder core rotatable therein, with a plurality of disk tumblers (also denoted as wafer tumblers) being provided in the cylinder core which have at least one respective engagement section. The wafer tumblers are movable between an unlatched position and a latched position and are biased along a respective bias direction into the latched position. In the latched position, the respective engagement section engages into an associated cut-out in the cylinder housing to block the cylinder core against a rotary movement relative to the cylinder housing. The cylinder core is rotatable in a rotary opening direction relative to the cylinder housing when the wafer tumblers are in the unlatched position.

BACKGROUND OF THE INVENTION

A problem with such a cylinder lock is the so-called locking picking. This is understood as the attempt to open a cylinder lock without force without a matching key. For this purpose, special opening tools are used with which the wafer tumblers are moved out of their respective latched position against the bias up to the ring gap between the cylinder housing and the cylinder core. If in so doing a suitable torque is simultaneously exerted onto the cylinder core in the rotary opening direction, for example by means of a so-called tensioning lever, it can thus be achieved in some cases while utilizing the usually present rotary play that the wafer tumblers catch at the edge of the associated cut-out of the cylinder housing so that the cylinder core can be rotated without the desired blocking effect. In this respect, one speaks of a "setting" of the wafer tumblers which is carried out sequentially for the individual wafer tumblers.

A cylinder lock of the kind named above is known from DE 10 2007 056 739 A1. With this cylinder lock, an increased security against locking picking is achieved in that at least two of the wafer tumblers have different rotary play between the engagement section of the respective wafer tumbler and the lateral boundary of the associated cut-out in the cylinder housing located in the rotary opening direction. Whereas such a cylinder lock has proven itself in practice, there is a need to increase the security against locking picking even further.

It is an object of the invention to provide a cylinder lock of the type of a wafer tumbler cylinder which has improved security against manipulation, in particular with respect to the explained locking picking.

This object is satisfied by a cylinder lock having at least one of the wafer tumblers has a toothed zone which can be brought into engagement with a counter-toothed zone of the cylinder lock such that the wafer tumbler is blocked against a movement of the respective direction of bias when the wafer tumbler is located in the latched position and a torque is exerted onto the cylinder core in the rotary opening position.

With the cylinder lock in accordance with the invention, a respective toothed zone of one or more of the wafer tumblers cooperates with an associated counter-toothed zone of the cylinder lock through a mutual toothed engagement such that the respective wafer tumbler is blocked in the latched position when a torque is exerted onto the cylinder core in the rotary opening direction. In this respect, a shape matching is caused between the named toothed zone and the associated counter-toothed zone. The "setting" of the respective wafer tumbler explained above is thus prevented, namely in that it is not permitted at all that the respective wafer tumbler is moved out of the latched position into the unlatched position in an unauthorized manner. In this respect, the circumstance is utilized that, on a typical manipulation attempt, a torque is simultaneously exerted onto the cylinder core in the rotary opening direction, which is not the case with an intended actuation of the cylinder lock by means of the associated key. In other words, the named toothed zone of the respective wafer tumbler enters into toothed engagement with the associated counter-toothed zone as soon as, starting from the latched position of the wafer tumbler, the cylinder core is rotated in the rotary opening direction (which is possible to a specific degree due to the rotary play which is present). The respective wafer tumbler can thus not be brought into the unlatched position at all from the start within the framework of a typical picking attempt so that there is also no risk that the wafer tumbler (and in particular all wafer tumblers sequentially) is held in the unlatched position.

SUMMARY OF THE INVENTION

Advantageous embodiments of the invention are named in the following and in the dependent claims.

In accordance with a particularly simple embodiment, the named toothed zone of the at least one wafer tumbler and the associated counter-toothed zone of the cylinder lock have at least one recess or at least one raised portion which can be introduced into the recess. The explained toothed engagement can hereby already be realized to be able to block the respective wafer tumbler in the latched position since anyway no particularly high forces can be transmitted by means of the picking tools usually used.

The mutual toothed engagement is furthermore particularly effective when the toothed zone of the at least one wafer tumbler and the associated counter-toothed zone of the cylinder lock cooperate in a direction which extends substantially perpendicular to the direction of bias. In other words, a shape matched connection can hereby be realized which particularly reliably prevents an unauthorized displacement of the wafer tumbler into the unlatched position.

In accordance with a further embodiment, the toothed zone of the at least one wafer tumbler and the counter-toothed zone of the cylinder lock cooperate within the cylinder core, i.e. radially within the ring gap between the cylinder housing and the cylinder core with respect to the axis of rotation. A simpler and more exact formation of the counter-toothed zone is hereby possible since this does not, for example, have to be worked into the named cut-out of the cylinder housing (for the engagement section of the wafer tumbler).

To ensure a proper function of the cylinder lock on an authorized actuation by means of the associated key despite the usual tolerances, it is preferred if the named toothed zone of the at least one wafer tumbler and the associated counter-toothed zone of the cylinder lock cooperate with one another such that the explained mutual engagement can be cancelled in that a torque is exerted onto the cylinder core against the rotary opening direction. To be able to cancel an unintended blocking of the respective wafer tumbler in the latched position due to the explained toothed engagement, it is therefore only necessary to rotate the cylinder core briefly against the rotary opening direction by means of the associated key.

In accordance with a further advantageous embodiment, the at least one wafer tumbler has a further engagement section in addition to the named engagement section, said further engagement section being disposed opposite the named engagement section with respect to the respective direction of bias. The wafer tumbler in this case blocks the cylinder core against a rotary movement relative to the cylinder housing even when the wafer tumbler is moved opposite to the respective direction of bias in the direction of a further latched position in which the further engagement section engages into an associated further cut-out in the cylinder housing. The wafer tumbler in this embodiment also has yet a further toothed zone which can be brought into engagement with the named counter-toothed zone of the cylinder lock such that the wafer tumbler is blocked against a movement along the respective direction of bias when the wafer tumbler is in the further latched position and a torque is exerted onto the cylinder core in the rotary opening direction. In other words, the further engagement section of the wafer tumbler likewise serves to block the cylinder core against a rotary movement relative to the cylinder housing if it should prove possible to move the wafer tumbler opposite to the direction of bias despite the explained toothed engagement (between the named toothed zone and the counter-toothed zone) and if the wafer tumbler in so doing is moved beyond the unlatched position into the further latched position. In such a case, the toothed engagement between the named further toothed zone and the associated counter-toothed zone results in a rotation of the cylinder core not being possible. This embodiment therefore contributes to a further increase of the security against manipulation.

In accordance with a preferred embodiment, the named counter-toothed zone is provided at at least one blocking element of the cylinder lock which is formed separately from the cylinder core and from the cylinder housing. The manufacture of the cylinder lock is hereby simplified since the counter-toothed zone can, for example, be made as an external toothed arrangement of the named blocking element and does not, for instance, have to be worked into a groove of the cylinder housing or the like.

On the presence of such a separate blocking element, it is furthermore preferred if it is movably supported at the cylinder core. The movability of a separate blocking element can be used to make the bringing into engagement of the named toothed zone and associated counter-toothed zone even more reliable and to provide additional protection against rotation for the cylinder core.

The named blocking element can in particular be pivotably supported at the named cylinder core, with the pivot axis preferably extending parallel to the axis of rotation of the cylinder core.

So that the counter-toothed zone of the named blocking element can also be reliably brought out of engagement with the associated toothed zone of the respective wafer tumbler again, it is furthermore preferred if the named blocking element is biased in the direction of the cylinder housing, that is in a direction away from the respective toothed zone or from the respective wafer tumbler.

Provided the named blocking element is movable, it is furthermore preferred if the blocking element is supported at the cylinder housing while the toothed zone of the respective wafer tumbler cooperates in the explained manner with the counter-toothed zone to block the wafer tumbler in the latched position. It is ensured by the support of the blocking element at the cylinder housing that, in the case of an application of a torque onto the cylinder core in the rotary opening direction, a mutual engagement is reliably established between the named toothed zone and the associated counter-toothed zone and that the blocking element in this respect does not, for instance, follow the rotary movement of the cylinder core. In other words, it is ensured that the blocking element of the associated wafer tumbler does not "run away".

It is of particular advantage if the named blocking element, while it is supported at the cylinder housing, blocks the cylinder core against a rotary movement relative to the cylinder housing. In other words, the named blocking element can (in addition to the cooperation of the engagement section of the respective wafer tumbler with the associated cut-out in the cylinder housing) form a security against rotation for the cylinder core. The wafer tumblers can thus have comparatively small dimensions. Particularly compact constructional shapes of the cylinder lock hereby result with a correspondingly small thickness of the wafer tumblers in particular in the axial direction (again with respect to the axis of rotation of the cylinder core).

In accordance with a further advantageous embodiment, the named wafer tumbler has, adjacent to the named toothed zone, a release cut-out into which the respective blocking element can engage when the wafer tumbler is in the latched position due to the proper use of the associated key, with the blocking of the cylinder core by the blocking element explained above being cancelled when the blocking element engages into the release cut-out of the wafer tumbler. The named release cut-out thus enables a movement of the blocking element to cancel the explained security against rotation between the cylinder core and the cylinder housing, with the corresponding movement of the blocking element only being possible, however, when the respective wafer tumbler is in the unlatched position.

In accordance with a further embodiment, a respective blocking element is associated with a plurality of wafer tumblers, in particular with all the wafer tumblers of the cylinder lock. A particularly high security against manipulation hereby results.

A common blocking element can in particular be associated with the plurality of wafer tumblers. A plurality of separate blocking elements is thus not necessary, with an advantageously simple structure of the cylinder lock resulting from this.

BRIEF DESCRIPTION OF THE DRAWINGS

The invention will be described in the following only by way of example with reference to the drawings.

DETAILED DESCRIPTION OF THE PREFERRED EMBODIMENTS

Figure 1:
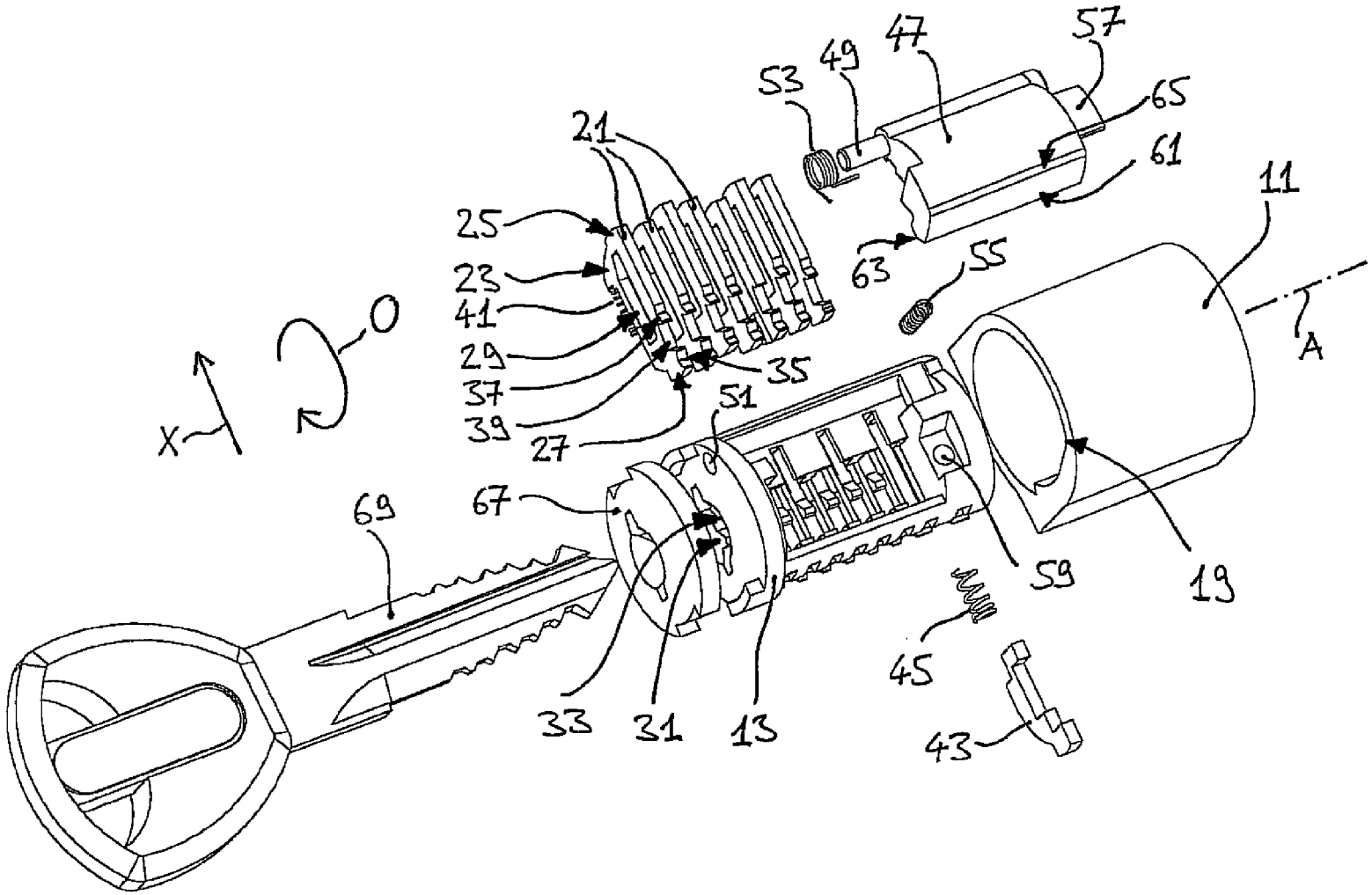
FIG. 1 shows a wafer tumbler lock in an exploded view.

The shown wafer tumbler cylinder lock will first be described mainly with respect to FIG. 1. The lock has a cylinder housing 11 and a cylinder core 13 rotatable therein. The cylinder housing 11 has a cut-out 15 and a further cut-out 17 (FIGS. 2*a* and 3*a*) which extend in groove shape at the inner jacket surface of the cylinder housing 11 parallel to the axis of rotation A of the cylinder core 13, with the two cut-outs 15, 17 being disposed diametrically opposite one another. The cylinder housing 11 furthermore has a blocking cut-out 19 at its inner jacket surface which likewise extends parallel to the axis of rotation A. The cut-outs 15, 17 and the blocking cut-out 19 form deviations from an essentially circular cross-section of the inner jacket surface of the cylinder housing 11.

A plurality of tumbler wafers 21 are held movably in translatory manner in the cylinder core 13. Each wafer tumbler 21 has a core section 23, an engagement section 25 and a further engagement section 27 disposed diametrically opposite thereto with respect to the axis of rotation A. The respective core section 23 surrounds a key opening 29 of the respective wafer tumbler, with the key openings 29 of the wafer tumblers 21 and an introduction opening 31 of the cylinder core 13 together forming a keyway 33. A toothed zone 35 and (adjacent hereto in the direction of bias X) a further toothed zone 37 are formed at each wafer tumbler 21. A release cut-out 39 is provided between the toothed zone 35 and the further toothed zone 37 of each wafer tumbler 21. The release cut-out 39 is thus likewise arranged adjacent to the respective toothed zone 35 in the direction of bias X. Furthermore, a biasing spring 41 is associated with each wafer tumbler 21 by means of which the wafer tumbler 21 is biased along a direction of bias X into a latched position to be explained in the following.

The shown wafer tumbler cylinder lock furthermore includes a tumbler 43 as a security against rotation which is likewise held movably in the cylinder core 13 and with which a biasing spring 45 is associated.

Figure 2B:
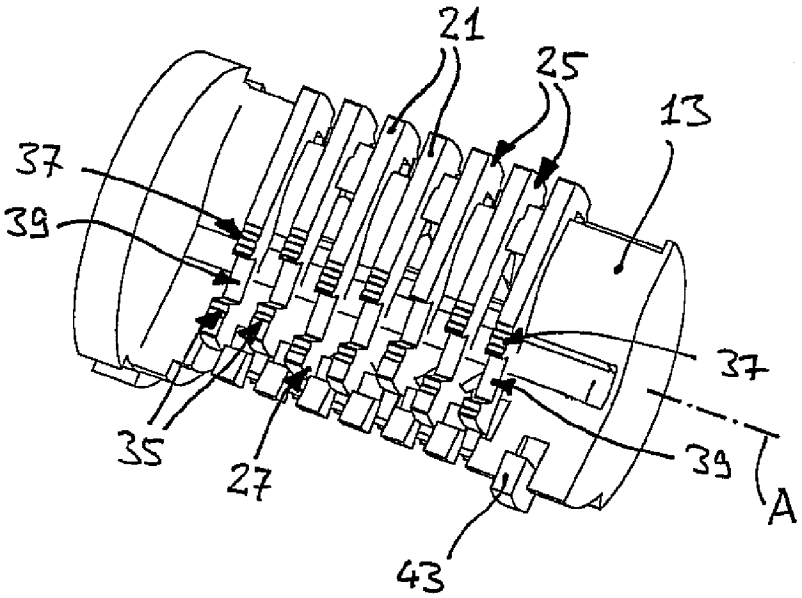
FIGS. 2*a* and 2*b* show the wafer tumbler lock in the latched state in a cross-sectional view or in a perspective view (without cylinder housing)
Figure 2A:
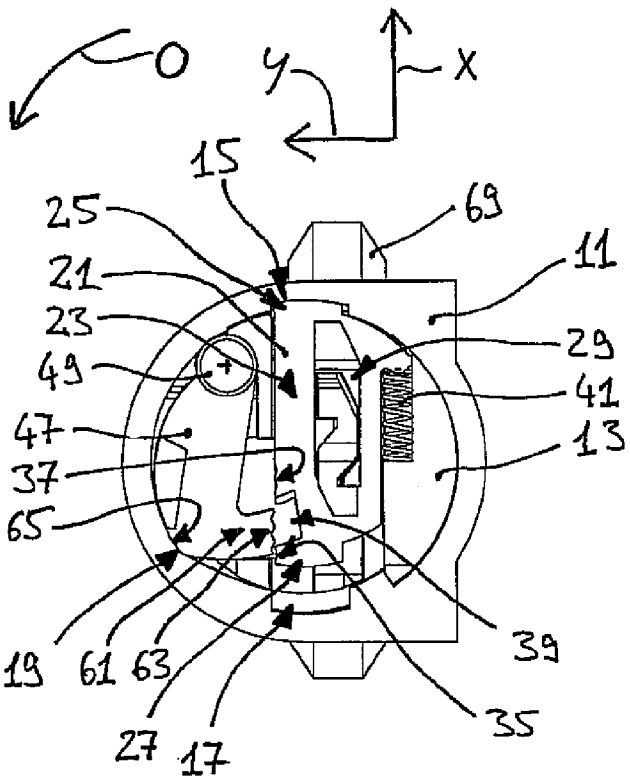
Figure 3B:
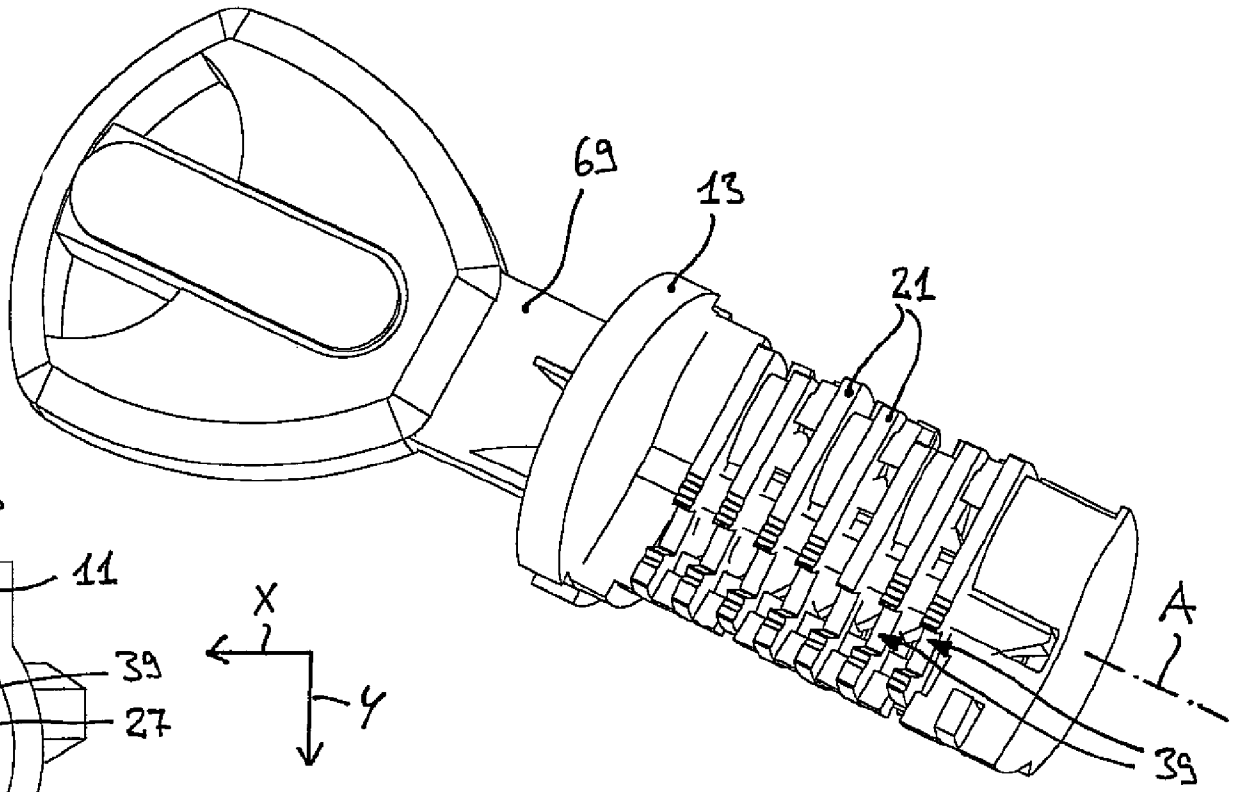
FIGS. 3*a* and 3*b* show the wafer tumbler in the unlatched state in a cross-sectional view (with the cylinder core being rotated by 90°) or in a perspective view (without cylinder housing).
Figure 3A:
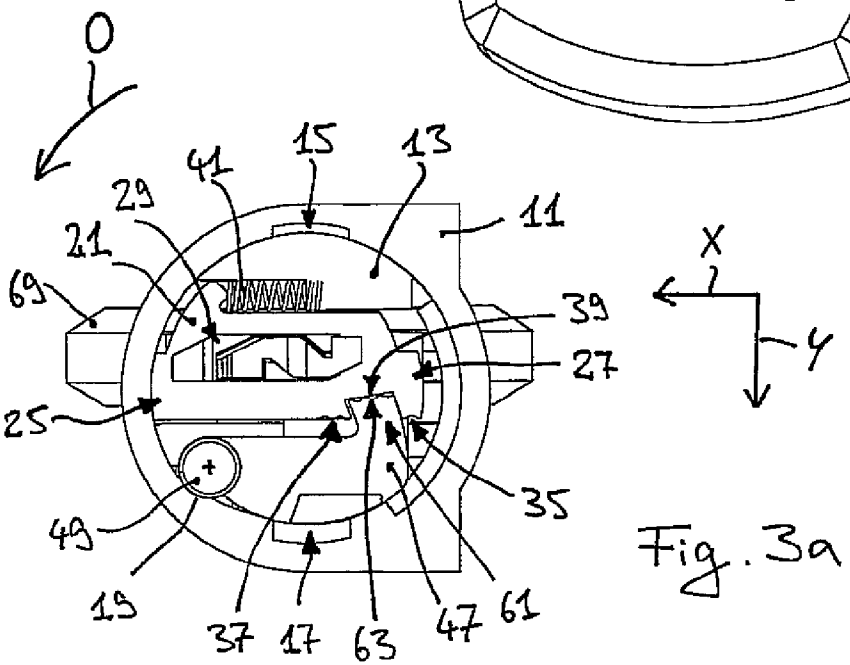

The wafer tumbler cylinder lock furthermore has a blocking element 47 which is pivotably journaled at the cylinder core 13 by means of a link pin 49 which engages into a linking opening 51 of the cylinder core 13. The link pin 49 passes through a torsion spring 53 which cooperates with the blocking element 47 and the cylinder core 13 to bias the blocking element 47 into a direction of bias Y away from the respective toothed zone 35 of the wafer tumblers 21, as will be explained in the following (FIGS. 2*a* and 3*a*). This bias is also supported by a compression spring 55 which engages between a support section 57 of the blocking element 47 and a spring mount 59 of the cylinder core 13. The blocking element 47 furthermore has a web section 61 which extends parallel to the axis of rotation A of the cylinder core 13. The web section 61 has a counter-toothed zone 63 at the side facing the wafer tumblers 21. The blocking element 47 furthermore has at its outer side remote from the wafer tumblers 21 a support section 65 which likewise extends parallel to the axis of rotation A.

The shown wafer tumbler lock furthermore includes a drill protection plate 67 and an associated key 69.

The general operation of the shown tumbler wafer cylinder lock will be explained in the following mainly with reference to FIGS. 2*a* and 3*a*. FIG. 2*a* shows the lock before the complete introduction of the associated key 69. Due to the bias by means of the respective biasing spring 41, the wafer tumblers 21 are in a latched position in which the respective engagement section 25 engages into the associated cut-out 15 of the cylinder housing 11. The cylinder core 13 is hereby blocked against a rotary movement relative to the cylinder housing 11. If, in contrast, the associated key 69 is introduced completely into the keyway 33, the wafer tumblers 21 are brought opposite to the direction of bias X into a respective unlatched position in which the engagement sections 25 are withdrawn from the cut-out 15 of the cylinder housing 11 at the level of the ring gap which is formed between the cylinder housing 11 and the cylinder core 13. The cylinder core 13 can now be rotated in the direction of opening O by means of the key 69. FIG. 3*a* shows the result of such a rotation through 90°. The rotational security tumbler 43 (FIG. 1) prevents a rotary actuation of the cylinder core 13 as long as the associated key 69 is not completely introduced into the keyway 33.

It must be noted that, for the different wafer tumblers 21, the directions of bias X can also be directed opposite to one another, in particular on the use of a reversible key 69. In this case, the latched position of one of the wafer tumblers 21 is therefore disposed diametrically opposite the latched position of another of the wafer tumblers 21.

A special feature of the shown wafer tumbler cylinder lock is the respective toothed zone 35 of the wafer tumblers 21 which cooperates with the counter-toothed zone 63 at the web section 61 of the pivotable blocking element 47. Provided that a torque is exerted onto the cylinder core 13 in the direction of opening O, as long as the respective wafer tumbler 21 is still in the latched position in accordance with FIG. 2*a*, the respective toothed zone 35 of the wafer tumblers 21 enters into shape matched engagement with the named counter-toothed zone 63. The blocking element 47 biased in the direction of bias Y is namely supported at the inner jacket surface of the cylinder housing 11, with the support section 65 of the blocking element 47 engaging into the blocking cut-out 19 of the cylinder housing 11 so that the blocking element 47 cannot escape backward despite the named torque loading onto the cylinder core 13. Due to the shape matched engagement thus brought about between the toothed zone 35 and the counter-toothed zone 63, the respective wafer tumbler 21 is blocked against a movement opposite to the direction of bias X, that is from the latched position shown in FIG. 2*a* in the direction of the unlatched position. The lock is hereby effectively protected against unauthorized opening by successive "setting" of the wafer tumblers 21 while applying a torque, with a displacement of the respective wafer tumblers 21 from the latched position into the unlatched position not being permitted at all.

The active direction of the named shape matched engagement between the respective toothed zone 35 and the counter-toothed zone 63 in this respect extends substantially perpendicular to the direction of bias X of the wafer tumblers 21, i.e. substantially parallel to the direction of bias Y of the blocking element 47. Due to the bias of the blocking element 47 in the direction Y, an unintentional mutual engagement of the toothed zone 35 of the wafer tumbler 21 and of the counter-toothed zone 63 of the blocking element 47 is prevented.

It is achieved by the engagement of the support section 65 of the blocking element 47 into the blocking cut-out 19 of the cylinder housing 11 that the blocking element 47 blocks the cylinder core 13 (in addition to the engagement sections 25 of the wafer tumblers 21) against a rotary movement relative to the cylinder housing 11 as long as the wafer tumblers 21 are in the latched position in accordance with FIG. 2*a*. However, as soon as all wafer tumblers 21 have been brought into the respective unlatched position by introduction of the associated key 69 into the keyway 33, the web section 61 of the blocking element 47 can pivot into the respective release cut-out 39 of the wafer tumblers 21 by rotating the cylinder core 13 in the rotary opening direction O so that the explained additional blocking effect of the blocking element 47 is cancelled. The inner jacket surface of the cylinder housing 11 in this respect acts as a slotted link guide for the pivot movement of the blocking element 47. FIG. 3*b* shows that the release cut-outs 39 of the wafer tumblers 21 in this state form a throughgoing groove for the reception of the web section 61 of the blocking element 47.

It can also still be seen from FIG. 2*a* that the further cut-out 17 of the cylinder housing 11 enables a cooperation with the respective further engagement section 27 of the wafer tumblers 21 to block the cylinder core 13 against a rotary movement relative to the cylinder housing 11 if the respective wafer tumbler 21 is moved out of the latched position in accordance with FIG. 2*a* beyond the explained latched position into a further latched position. In this case, a shape matched engagement is effected between the further toothed zone 37 of the respective wafer tumbler 21 and the counter-toothed zone 63 of the blocking element 47 to prevent a movement back of the wafer tumbler 21 as long as a torque is exerted onto the cylinder core 13 in the rotary opening direction O.

The invention claimed is:

1. A cylinder lock of the type of a wafer tumbler cylinder, having a cylinder housing and a cylinder core rotatable therein, wherein a plurality of wafer tumblers are provided in the cylinder core which have at least one respective engagement section, with the wafer tumblers being movable between an unlatched position and a latched position and being biased along a respective direction of bias into the latched position, with the respective engagement section engaging in the latched position into an associated cut-out in the cylinder housing to block the cylinder core against a rotary movement relative to the cylinder housing, and with the cylinder core being rotatable relative to the cylinder housing in a rotary opening direction when the wafer tumblers are in the unlatched position, wherein at least one of the wafer tumblers has a toothed zone which can be brought into engagement with a counter-toothed zone of the cylinder lock such that said at least one wafer tumbler is blocked against a movement opposite to the respective direction of bias when said at least one wafer tumbler is in the latched position and a torque is exerted onto the cylinder core in the rotary opening direction, wherein the toothed zone of the at least one wafer tumbler and the counter-toothed zone of the cylinder lock abut within and radially inwardly spaced from the outer periphery of the cylinder core, wherein said at least one wafer tumbler has a further engagement section which is disposed opposite the respective engagement section with respect to the respective direction of bias, wherein said at least one wafer tumbler blocks the cylinder core against a rotary movement relative to the cylinder housing when said at least one wafer tumbler is moved opposite to the respective direction of bias in the direction of a further latched position in which the further engagement section engages into an associated further cut-out in the cylinder housing, wherein said at least one wafer tumbler has a further toothed zone which can be brought into engagement with the counter-toothed zone of the cylinder lock such that said at least one wafer tumbler is blocked against a movement along the respective direction of bias when said at least one wafer tumbler is in the further latched position and a torque is exerted onto the cylinder core in the rotary opening direction, wherein also the further toothed zone of said at least one wafer tumbler and the counter-toothed zone of the cylinder lock abut within and radially inwardly spaced from the outer periphery of the cylinder core, wherein the toothed zone of the at least one wafer tumbler and the counter-toothed zone of the cylinder lock mesh such that a torque exerted onto the cylinder core against the rotary opening direction moves said at least one wafer tumbler and the counter-toothed zone of the cylinder lock out of mesh with each other.

2. A cylinder lock in accordance with claim 1, wherein an axis of each tooth in the toothed zone of the at least one wafer tumbler and the counter-toothed zone of the cylinder lock extends in a direction which extends substantially perpendicular to the respective direction of bias.

3. A cylinder lock in accordance with claim 1, wherein the counter-toothed zone is provided at at least one blocking element of the cylinder lock which is made separately from the cylinder core and from the cylinder housing.

4. A cylinder lock in accordance with claim 3, wherein the at least one blocking element is movably supported at the cylinder core.

5. A cylinder lock in accordance with claim 3, wherein the at least one blocking element is pivotably movable relative to the cylinder core.

6. A cylinder lock in accordance with claim 3, wherein the at least one blocking element is supported at the cylinder housing while the toothed zone of the at least one wafer tumbler meshes with the counter-toothed zone of the at least one blocking element.

7. A cylinder lock in accordance with claim 6, wherein the at least one blocking element blocks, while it is supported at the cylinder housing, the cylinder core against a rotary movement relative to the cylinder housing.

8. A cylinder lock in accordance with claim 7, wherein the at least one wafer tumbler has, adjacent to the toothed zone, a release cut-out into which the at least one blocking element can be introduced when the wafer tumbler is in the unlatched position, with the blocking of the cylinder core by the blocking element being cancelled when the blocking element engages into the release cut-out of the at least one wafer tumbler.

9. A cylinder lock in accordance with claim 6, wherein the at least one blocking element engages, while it is mounted to the cylinder housing, into a blocking cut-out in the cylinder housing.

10. A cylinder lock in accordance with claim 3, wherein a blocking element is associated with a plurality of wafer tumblers.

11. A cylinder lock of the type of a wafer tumbler cylinder, having a cylinder housing and a cylinder core rotatable therein, wherein a plurality of wafer tumblers are provided in the cylinder core which have at least one respective engagement section, with the wafer tumblers being movable between an unlatched position and a latched position and being biased along a respective direction of bias into the latched position, with the respective engagement section engaging in the latched position into an associated cut-out in the cylinder housing to block the cylinder core against a rotary movement relative to the cylinder housing, and with the cylinder core being rotatable relative to the cylinder housing in a rotary opening direction when the wafer tumblers are in the unlatched position, wherein at least one of the wafer tumblers has a toothed zone which can be brought into engagement with a counter-toothed zone of the cylinder lock such that said at least one wafer tumbler is blocked against a movement opposite to the respective direction of bias when said at least one wafer tumbler is in the latched position and a torque is exerted onto the cylinder core in the rotary opening direction, wherein the counter-toothed zone is provided at at least one blocking element of the cylinder lock which is made separately from the cylinder core and from the cylinder housing, wherein the at least one blocking element is pivotably movable relative to the cylinder core, wherein the at least one blocking element is supported at the cylinder housing while the toothed zone of the at least one wafer tumbler meshes with the counter-toothed zone of the at least one blocking element, wherein the at least one blocking element blocks, while it is supported at the cylinder housing, the cylinder core against a rotary movement relative to the cylinder housing, wherein the at least one wafer tumbler has, adjacent to the toothed zone, a release cut-out into which the at least one blocking element can be introduced when the wafer tumbler is in the unlatched position, with the blocking of the cylinder core by the blocking element being cancelled when the blocking element engages into the release cut-out of the at least one wafer tumbler.

12. A cylinder lock in accordance with claim 11, wherein the at least one blocking element is biased so that it pivots towards the cylinder housing.

13. A cylinder lock in accordance with claim 11, wherein the at least one blocking element engages, while it is mounted to the cylinder housing, into a blocking cut-out in the cylinder housing.

14. A cylinder lock of the type of a wafer tumbler cylinder, having a cylinder housing and a cylinder core rotatable therein, wherein a plurality of wafer tumblers are provided in the cylinder core which have at least one respective engagement section, with the wafer tumblers being movable between an unlatched position and a latched position and being biased along a respective direction of bias into the latched position, with the respective engagement section engaging in the latched position into an associated cut-out in the cylinder housing to block the cylinder core against a rotary movement relative to the cylinder housing, and with the cylinder core being rotatable relative to the cylinder housing in a rotary opening direction when the wafer tumblers are in the unlatched position, wherein at least one of the wafer tumblers has a toothed zone which can be brought into engagement with a counter-toothed zone of the cylinder lock such that said at least one wafer tumbler is blocked against a movement opposite to the respective direction of bias when said at least one wafer tumbler is in the latched position and a torque is exerted onto the cylinder core in the rotary opening direction, wherein the toothed zone of the at least one wafer tumbler and the counter-toothed zone of the cylinder lock abut within and radially inwardly spaced from the outer periphery of the cylinder core, wherein said at least one wafer tumbler has a further engagement section which is disposed opposite the respective engagement section with respect to the respective direction of bias, wherein said at least one wafer tumbler blocks the cylinder core against a rotary movement relative to the cylinder housing when said at least one wafer tumbler is moved opposite to the respective direction of bias in the direction of a further latched position in which the further engagement section engages into an associated further cut-out in the cylinder housing, wherein said at least one wafer tumbler has a further toothed zone which can be brought into engagement with the counter-toothed zone of the cylinder lock such that said at least one wafer tumbler is blocked against a movement along the respective direction of bias when said at least one wafer tumbler is in the further latched position and a torque is exerted onto the cylinder core in the rotary opening direction, wherein also the further toothed zone of said at least one wafer tumbler and the counter-toothed zone of the cylinder lock abut within and radially inwardly spaced from the outer periphery of the cylinder core, wherein the counter-toothed zone is provided at at least one blocking element of the cylinder lock which is made separately from the cylinder core and from the cylinder housing, wherein the at least one blocking element is supported at the cylinder housing while the toothed zone of the at least one wafer tumbler meshes with the counter-toothed zone of the at least one blocking element, wherein the at least one blocking element blocks, while it is supported at the cylinder housing, the cylinder core against a rotary movement relative to the cylinder housing, wherein the at least one wafer tumbler has, adjacent to the toothed zone, a release cut-out into which the at least one blocking element can be introduced when the wafer tumbler is in the unlatched position, with the blocking of the cylinder core by the blocking element being cancelled when the blocking element engages into the release cut-out of the at least one wafer tumbler.

15. A cylinder lock of the type of a wafer tumbler cylinder, having a cylinder housing and a cylinder core rotatable therein, wherein a plurality of wafer tumblers are provided in the cylinder core which have at least one respective engagement section, with the wafer tumblers being movable between an unlatched position and a latched position and being biased along a respective direction of bias into the latched position, with the respective engagement section engaging in the latched position into an associated cut-out in the cylinder housing to block the cylinder core against a rotary movement relative to the cylinder housing, and with the cylinder core being rotatable relative to the cylinder housing in a rotary opening direction when the wafer tumblers are in the unlatched position, wherein at least one of the wafer tumblers has a toothed zone which can be brought into engagement with a counter-toothed zone of the cylinder lock such that said at least one wafer tumbler is blocked against a movement opposite to the respective direction of bias when said at least one wafer tumbler is in the latched position and a torque is exerted onto the cylinder core in the rotary opening direction, wherein the toothed zone of the at least one wafer tumbler and the counter-toothed zone of the cylinder lock abut within and radially inwardly spaced from the outer periphery of the cylinder core, wherein said at least one wafer tumbler has a further engagement section which is disposed opposite the respective engagement section with respect to the respective direction of bias, wherein said at least one wafer tumbler blocks the cylinder core against a rotary movement relative to the cylinder housing when said at least one wafer tumbler is moved opposite to the respective direction of bias in the direction of a further latched position in which the further engagement section engages into an associated further cut-out in the cylinder housing, wherein said at least one wafer tumbler has a further toothed zone which can be brought into engagement with the counter-toothed zone of the cylinder lock such that said at least one wafer tumbler is blocked against a movement along the respective direction of bias when said at least one wafer tumbler is in the further latched position and a torque is exerted onto the cylinder core in the rotary opening direction, wherein also the further toothed zone of said at least one wafer tumbler and the counter-toothed zone of the cylinder lock abut within and radially inwardly spaced from the outer periphery of the cylinder core, wherein the counter-toothed zone is provided at at least one blocking element of the cylinder lock which is made separately from the cylinder core and from the cylinder housing, wherein the at least one blocking element is supported at the cylinder housing while the toothed zone of the at least one wafer tumbler meshes with the counter-toothed zone of the at least one blocking element, wherein the at least one blocking element engages, while it is mounted to the cylinder housing, into a blocking cut-out in the cylinder housing.

16. A cylinder lock of the type of a wafer tumbler cylinder, having a cylinder housing and a cylinder core rotatable therein, wherein a plurality of wafer tumblers are provided in the cylinder core which have at least one respective engagement section, with the wafer tumblers being movable between an unlatched position and a latched position and being biased along a respective direction of bias into the latched position, with the respective engagement section engaging in the latched position into an associated cut-out in the cylinder housing to block the cylinder core against a rotary movement relative to the cylinder housing, and with the cylinder core being rotatable relative to the cylinder housing in a rotary opening direction when the wafer tumblers are in the unlatched position, wherein at least one of the wafer tumblers has a toothed zone, wherein the cylinder lock comprises at least one blocking element which is made separately from the cylinder core and from the cylinder housing and which is pivotably movable relative to the cylinder core, wherein the at least one blocking element has a counter-toothed zone, wherein in a disengaged condition the toothed zone of the at least one wafer tumbler and the counter-toothed zone of the at least one blocking element are not in engagement with one another, wherein, when said at least one wafer tumbler is in the latched position, the at least one wafer tumbler and the at least one blocking element are adapted to be brought from the disengaged condition into a blocking engagement with one another by exerting a torque onto the cylinder core in the rotary opening direction such that said at least one blocking element blocks the at least one wafer tumbler relative to the cylinder core against a movement opposite to the respective direction of bias, wherein the toothed zone of the at least one wafer tumbler and the counter-toothed zone of the at least one blocking element abut within and radially inwardly spaced from the outer periphery of the cylinder core.

17. A cylinder lock in accordance with claim 16, wherein said at least one wafer tumbler has a further engagement section which is disposed opposite the respective engagement section with respect to the respective direction of bias, wherein said at least one wafer tumbler blocks the cylinder core against a rotary movement relative to the cylinder housing when said at least one wafer tumbler is moved opposite to the respective direction of bias in the direction of a further latched position in which the further engagement section engages into an associated further cut-out in the cylinder housing, wherein said at least one wafer tumbler has a further toothed zone which can be brought into engagement with the counter-toothed zone of the cylinder lock such that said at least one wafer tumbler is blocked against a movement along the respective direction of bias when said at least one wafer tumbler is in the further latched position and a torque is exerted onto the cylinder core in the rotary opening direction, wherein also the further toothed zone of said at least one wafer tumbler and the counter-toothed zone of the cylinder lock abut within and radially inwardly spaced from the outer periphery of the cylinder core.

* * * * *